US009093772B2

(12) United States Patent
Johnson et al.

(10) Patent No.: US 9,093,772 B2
(45) Date of Patent: Jul. 28, 2015

(54) LOCKOUT DEVICE

(75) Inventors: Mark Johnson, Hubertus, WI (US); Ray Wojtak, Waterford, WI (US)

(73) Assignee: Master Lock Company LLC, Oak Creek, WI (US)

( * ) Notice: Subject to any disclaimer, the term of this patent is extended or adjusted under 35 U.S.C. 154(b) by 332 days.

(21) Appl. No.: 13/594,001

(22) Filed: Aug. 24, 2012

(65) Prior Publication Data

US 2013/0052846 A1 Feb. 28, 2013

Related U.S. Application Data

(60) Provisional application No. 61/527,815, filed on Aug. 26, 2011.

(51) Int. Cl.
*H01R 13/44* (2006.01)
*H01R 13/60* (2006.01)
*H01R 13/639* (2006.01)

(52) U.S. Cl.
CPC ..... *H01R 13/44* (2013.01); *H01R 13/6397* (2013.01); *Y10T 29/49826* (2015.01)

(58) Field of Classification Search
CPC ..... H01R 13/44; H01R 13/6397
USPC ..... 439/149, 134, 133, 150
See application file for complete search history.

(56) References Cited

U.S. PATENT DOCUMENTS 1,959,713 A * 5/1934 Goff et al. ..... 439/758
2,664,734 A 1/1954 McEneaney
2,733,416 A 1/1956 Evatt
4,445,738 A 5/1984 Wiencke
4,566,297 A 1/1986 Hawley
4,653,824 A 3/1987 Phillipp et al.
4,932,886 A 6/1990 Glaser
5,055,057 A 10/1991 Boyer
5,074,807 A 12/1991 Parmer
5,507,656 A * 4/1996 Ales ..... 439/134
5,551,884 A 9/1996 Burkhart, Sr.
5,791,931 A 8/1998 Burkhart, Sr.
6,193,539 B1 2/2001 Chang
6,220,902 B1 4/2001 Ivandic et al.

(Continued)

OTHER PUBLICATIONS

International Search Report and Written Opinion from International Application No. PCT/US2012/52220, dated Nov. 6, 2012, 9 pages.

(Continued)

*Primary Examiner* — Felix O Figueroa
(74) *Attorney, Agent, or Firm* — Calfee, Halter & Griswold LLP

(57) ABSTRACT

A lockout device configured to be lockingly secured to an external structure includes a housing defining an opening sized to receive the external structure, at least one gripping member disposed within the housing and positioned to receive the external structure, and a driving member assembled with the housing. The at least one gripping member is movable in an axial direction between a first position in which internal surfaces of the housing urge the at least one gripping member into gripping engagement with the external structure, and a second position in which the internal surfaces of the housing allow the at least one gripping member to expand to release the external structure. The driving member is operatively connected with the at least one gripping member for movement of the at least one gripping member between the first and second positions.

19 Claims, 17 Drawing Sheets

(56) References Cited

U.S. PATENT DOCUMENTS

| | | | | |
|---|---|---|---|---|
| 6,461,176 | B1 | 10/2002 | Haas | |
| 6,508,654 | B1 | 1/2003 | Tatz | |
| 6,652,307 | B2 | 11/2003 | Tatz | |
| 6,773,277 | B2 | 8/2004 | Issa | |
| 6,945,805 | B1 | 9/2005 | Bollinger | |
| 6,979,220 | B1 | 12/2005 | Ray et al. | |
| 6,981,888 | B2 | 1/2006 | O'Keefe et al. | |
| 6,986,674 | B1 | 1/2006 | Gorman | |
| 7,104,818 | B1 | 9/2006 | Chang | |
| 7,175,463 | B2 | 2/2007 | Burton | |
| 7,320,611 | B2 | 1/2008 | Abbott | |
| 7,497,705 | B2 * | 3/2009 | Larson et al. | 439/133 |
| 7,578,691 | B2 | 8/2009 | Weksler | |
| 7,811,113 | B2 | 10/2010 | Hughes | |
| 2002/0115331 | A1 | 8/2002 | Ho | |
| 2003/0207606 | A1 | 11/2003 | Ho | |
| 2007/0026713 | A1 | 2/2007 | Hughes et al. | |
| 2007/0287323 | A1 | 12/2007 | Colescott | |

OTHER PUBLICATIONS

International Search Report and Written Opinion from International Application No. PCT/US2007/19815, mailed Apr. 21, 2008, 9 pages.

Patent Examination Report No. 1 from Australian Patent Application No. 2012300440, date of issue Nov. 26, 2014.

Search report from European Application No. 12826729.1 dated Apr. 10, 2015.

* cited by examiner

LOCKOUT DEVICE

CROSS-REFERENCE TO RELATED APPLICATION

This application claims the benefit of U.S. Provisional Patent Application Ser. No. 61/527,815, entitled "LOCKOUT DEVICE" and filed Aug. 26, 2011, the entire disclosure of which is incorporated herein by reference, to the extent that it is not conflicting with the present application.

BACKGROUND

Many electrical devices are used in applications where it may be desirable to restrict access to their use, for example, where such use may be dangerous when involving unqualified individuals or where an electrical device is not functioning properly. While access to some electrical devices may be restricted by electronic safeguards, such as, for example, by electronic passcodes or key cards, a simpler arrangement for preventing use of an electrical device may involve use of a power connection lockout device, in which an enclosure or other obstruction is lockably secured to a power connection by which the electrical device is powered, thereby preventing electrical connection of the electrical device to a power source, such as a corresponding socket or other such connector.

SUMMARY

According to an exemplary aspect of the present application, a lockout device is configured to be lockingly secured to an external structure extending in an axial direction, for example, to prevent access to the external structure. In an exemplary embodiment, a lockout device configured to be lockingly secured to an external structure includes a housing defining an opening sized to receive the external structure, at least one gripping member disposed within the housing and positioned to receive the external structure, and a driving member assembled with the housing. The at least one gripping member is movable in an axial direction between a first position in which internal surfaces of the housing urge the at least one gripping member into gripping engagement with the external structure, and a second position in which the internal surfaces of the housing allow the at least one gripping member to expand to release the external structure. The driving member is operatively connected with the at least one gripping member for movement of the at least one gripping member between the first and second positions.

According to another exemplary aspect of the present application, an exemplary method of locking out a power connection including at least a first pin is described. In the exemplary method, the first pin is inserted into an opening in a housing of a lockout device and between gripping surfaces of at least one gripping member disposed within the housing. A driving member, operatively connected with the at least one gripping member and assembled with the housing, is actuated from a release position to a lockout position, to axially move the at least one gripping member within the housing, such that internal surfaces of the housing urge the at least one gripping member into gripping engagement with the first pin.

According to still another exemplary aspect of the present application, a lockout device configured to be lockingly secured to a cylindrical pin of a male electrical connector of an aircraft includes a housing defining an opening sized to receive the cylindrical pin and at least one gripping member disposed within the housing and positioned to receive the cylindrical pin. The at least one gripping member is movable in an axial direction between a first position in which internal surfaces of the housing urge the at least one gripping member into gripping engagement with the cylindrical pin, and a second position in which the internal surfaces of the housing allow the at least one gripping member to expand to release the cylindrical pin.

BRIEF DESCRIPTION OF THE DRAWINGS

Further features and advantages of the invention will become apparent from the following detailed description made with reference to the accompanying drawings, wherein.

DETAILED DESCRIPTION

Figure 1A:
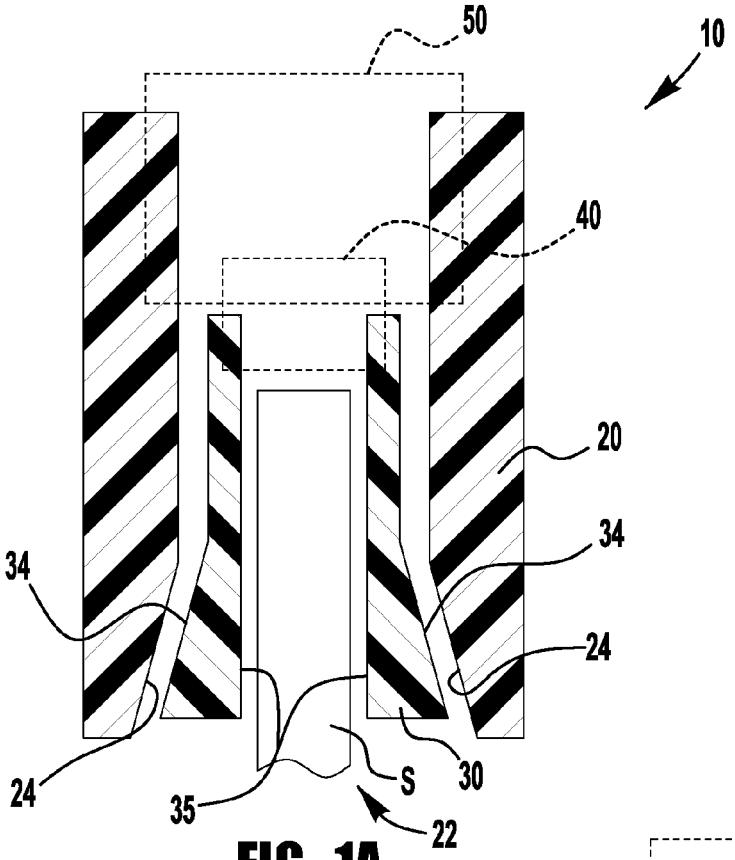
FIG. 1A is a schematic cross-sectional view of a lockout device assembled with an axially extending structure in an unlocked condition.

This Detailed Description merely describes embodiments of the invention and is not intended to limit the scope of the claims in any way. Indeed, the invention as claimed is broader than and unlimited by the preferred embodiments, and the terms used in the claims have their full ordinary meaning.

Also, while the detailed exemplary embodiments described in the specification and illustrated in the drawings relate to a lockout device for a pin-style electrical power connection, as conventionally used in an aircraft power connector, it should be understood that many of the inventive features described herein may be applied to other types of lockout devices for use with other types of connectors and components, including, for example, mechanical connectors, conduits, and control instruments.

The present application contemplates, in part, a lockout device for an axially extending structure, such as, for example, a pin-style electrical power connection, a conduit, or an instrument, to prevent connection with, insertion of, manipulation of, or other such access to the axially extending structure. According to an aspect of the present application, a lockout device may be configured to grip the axially extending structure when in a locking condition, such that a housing of the lockout device blocks access to the axially extending structure, and cannot be removed from the structure without first unlocking the device. In one embodiment, a lockout device includes one or more gripping members disposed within a housing. The gripping member or members are configured to be moved into gripping engagement with the axially extending structure by a driving member when the housing is installed over the axially extending structure and the driving member is moved from the unlocked condition to the locking condition. Movement of the driving member out of the locking condition may be prevented by blocking access to and/or movement of the driving member, for example, with a locking component (e.g., a padlock) assembled with or integral to the lockout device.

Figure 1B:
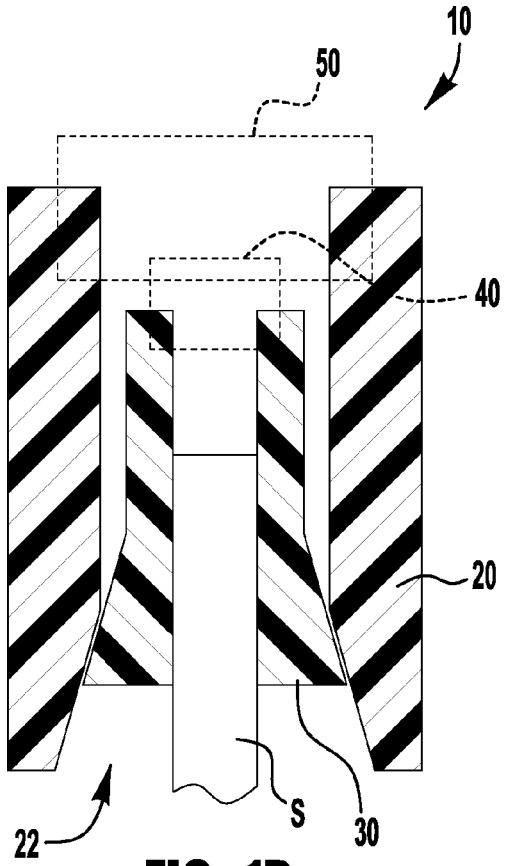
FIG. 1B is a schematic cross-sectional view of the lockout device of FIG. 1A, assembled with an axially extending structure in a locking condition.
Figure 2:
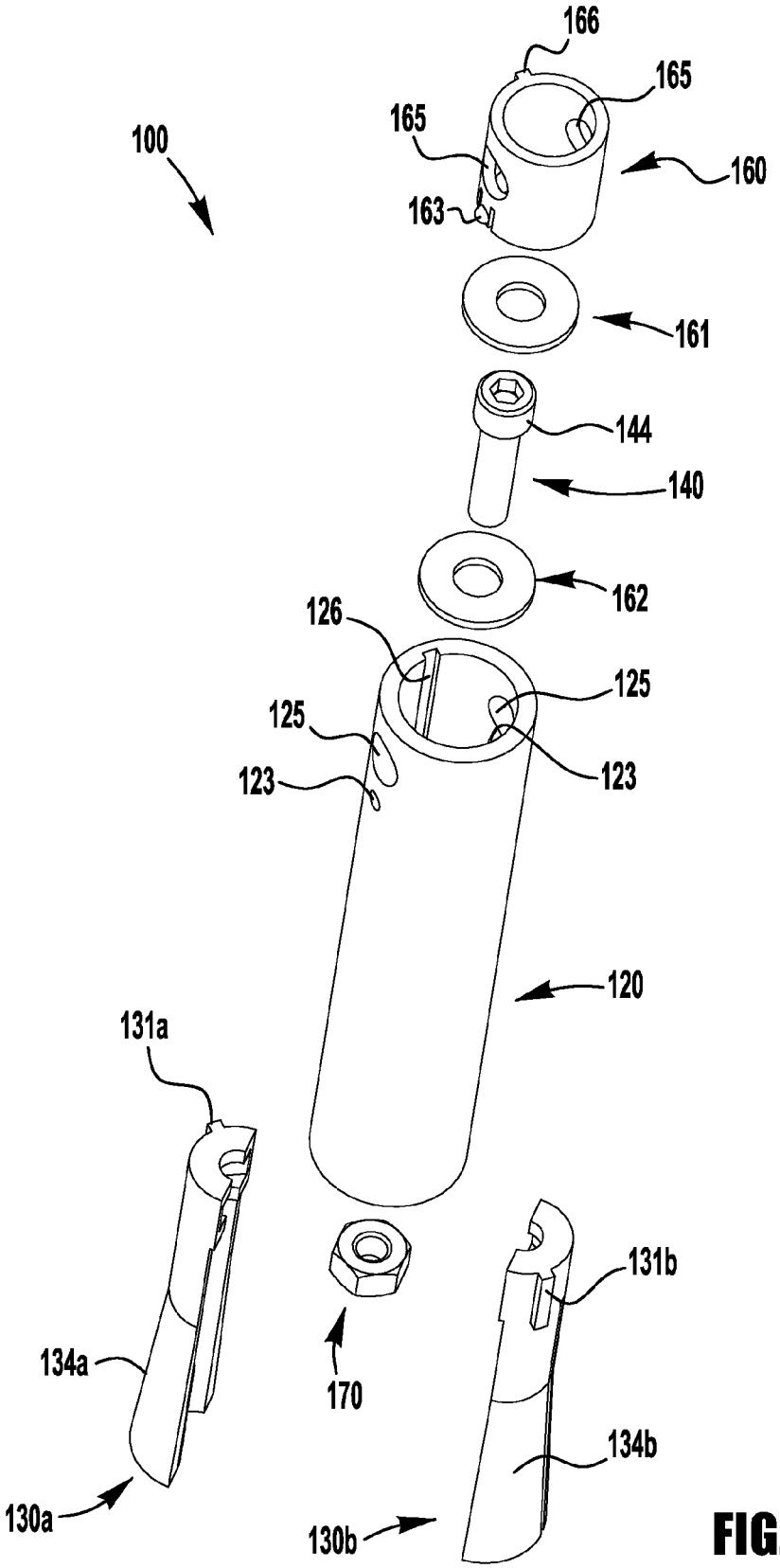
FIG. 2 is an exploded upper perspective view of an exemplary lockout device.
Figure 3:
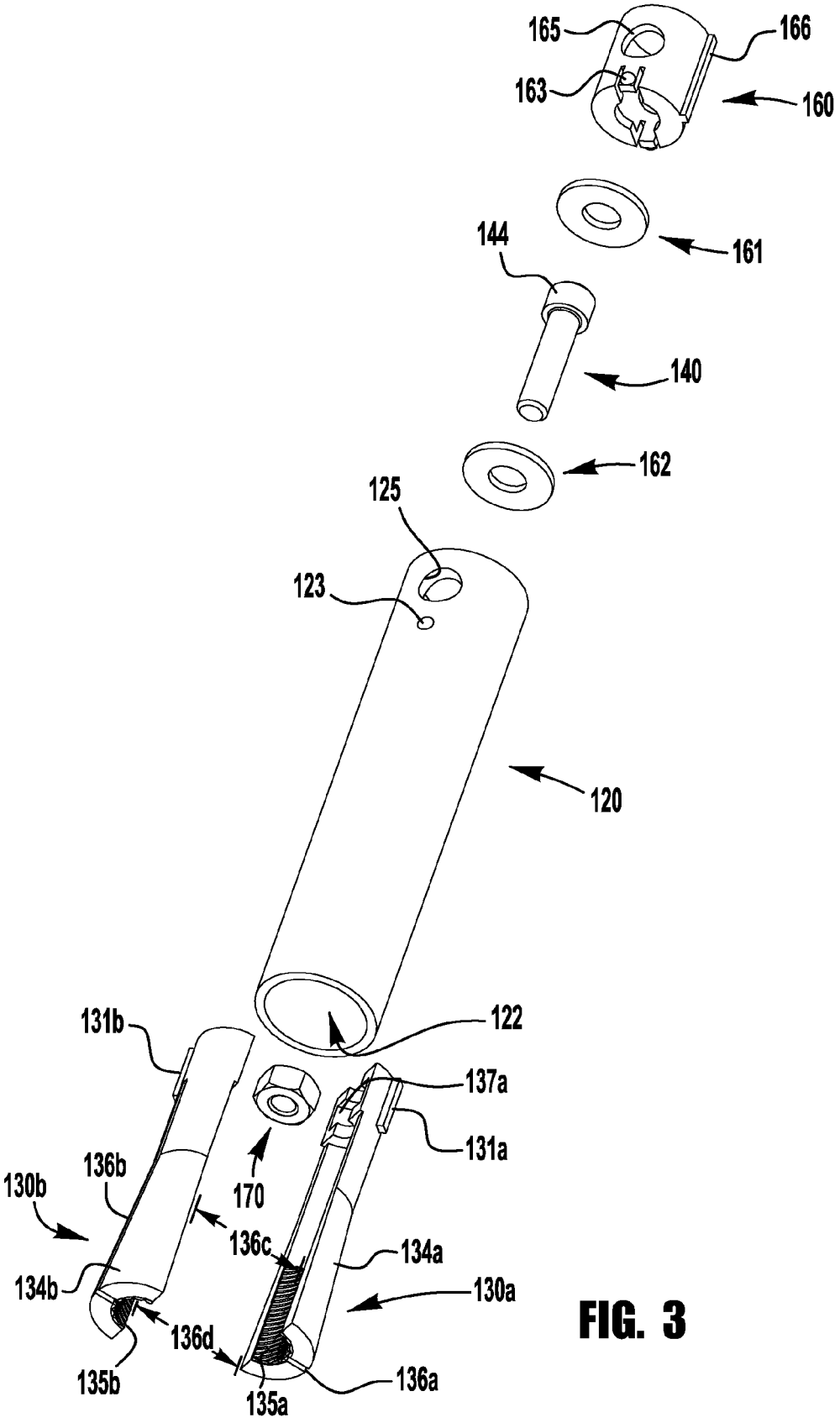
FIG. 3 is an exploded lower perspective view of the lockout device of FIG. 2.
Figure 4A:
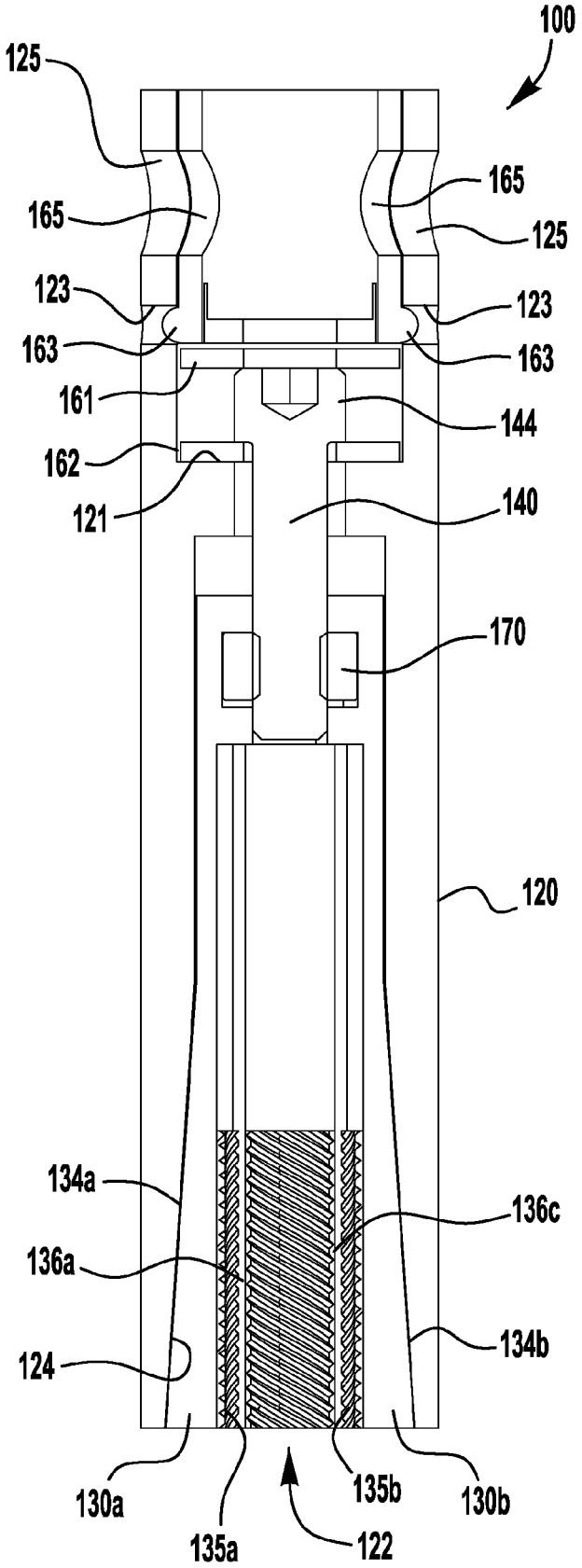
FIG. 4A is a side cross-sectional view of the lockout device of FIG. 2.
Figure 4B:
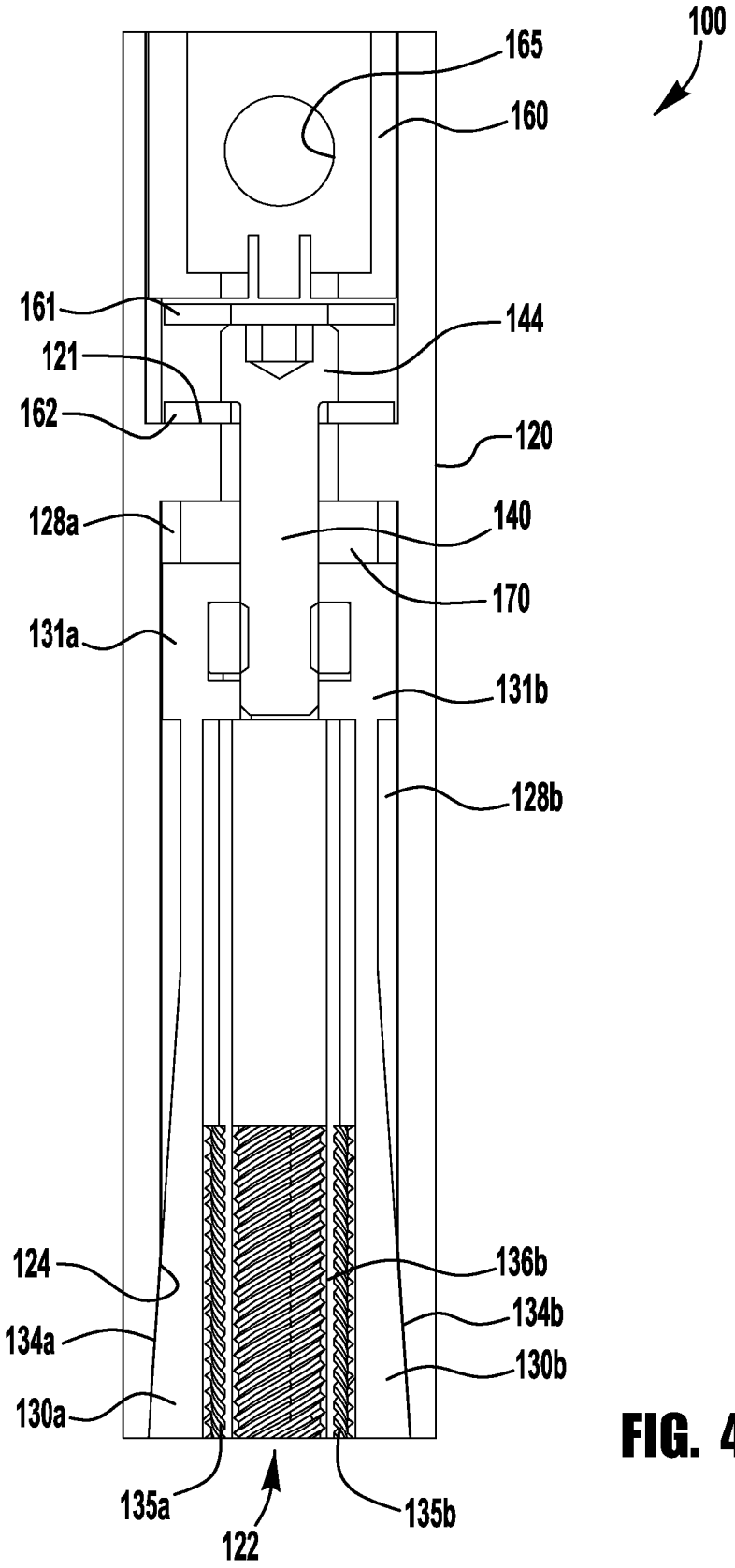
FIG. 4B is another side cross-sectional view of the lockout device of FIG. 2.

In one exemplary embodiment, as shown schematically in FIGS. 1A and 1B, a lockout device 10 is configured to be secured to an axially extending structure S to block access to the structure. The lockout device 10 includes a housing 20 defining an opening 22 sized to receive an end portion of the structure S, and one or more gripping members 30 disposed within the housing 20 and positioned to receive the structure end portion therethrough or therebetween when the structure end portion is inserted into the opening 22. A driving member, shown schematically at 40, is operatively connected with the one or more gripping members 30, such that when the driving member 40 is moved to the locking condition, the one or more gripping members contract or constrict against the structure end portion to securely grip the axially extending structure S. Many different types of movement of the driving member 40 may be utilized to constrict the one or more gripping members 30, including, for example, rotational, pivotal, axial, and/or radial movement. In the illustrated example, the gripping members 30 are moved in an axial direction to engage guiding internal surfaces 24 of the housing 20 with mating outer surfaces 34 of the gripping member(s), which force or otherwise urge internal gripping surfaces 35 of the gripping member(s) 30 radially inward into gripping engagement with the axially extending structure S. As shown, one or both of the guiding surfaces 24 and mating surfaces 34 may be tapered or otherwise contoured to facilitate constriction and expansion of the gripping members 30 during axial movement. Other arrangements, such as roller/ball bearings or flexing movement, may additionally or alternatively be utilized. A gradual taper or other feature providing for gradual constriction of the gripping members may facilitate gripping of structures having minor variations in diameter, thickness, or other such dimensions. A locking component, shown schematically at 50, may be secured with the lockout device 10 (e.g., secured with the housing 20, the driving member 40, and/or the gripping member(s) 30) to block access to and/or movement of the driving member 40. While the locking component 50 may include any suitable locking arrangement assembled with or integral with the lockout device 10, in one embodiment, a padlock shackle may be secured through an aperture in one or more of the housing 20, driving member 40, and gripping member(s) 30 to block access to and/or movement of the driving member 40.

Many different types of driving members may be utilized to axially move gripping members within the housing of a lockout device. In one embodiment, a driving member includes an axially fixed first threaded member, such as a bolt, that is in threaded engagement with a second threaded member, such as a nut, that is axially fixed to or captured by one or more gripping members disposed in the lock housing. Rotation of the first threaded member causes axial movement of the second threaded member, which axially drives the one or more gripping members.

A lockout device may be secured in a locked condition using many different arrangements. In one such arrangement, a lockout device is configured to receive a locking component such that the locking component blocks access to a driving member of the lockout device to prevent manipulation of the driving member for movement to the unlocked condition. FIGS. 2-4B illustrate exploded perspective and cross-sectional views of an exemplary embodiment of a lockout device 100 for a pin-style electrical connector, with the lockout device 100 configured to receive a locking component (such as a padlock, not shown) to block user access to a driving member. The lockout device 100 includes a housing 120, first and second gripping members or collets 130*a*, 130*b*, a threaded driving member 140, and a threaded driven member 170 captured between the gripping members 130*a*, 130*b* in cavities 137*a*, 137*b*. The exemplary driving member 140 is a threaded bolt axially fixed between a lower washer 162 and stepped portion 121 of the housing 120 and an upper washer 161 and cap member 160. The cap member 160 may be secured to the housing 120 using any suitable arrangement, including, for example, flexible detents 163 that snap into engagement with corresponding holes 123 in the housing 120, as shown. The cap member 160 may be further rotationally secured to the housing 120 using any suitable arrangement, including, for example, a rib 166 received in an internal notch 126 in the housing 120.

To secure the lockout device 100 to the external structure in a locking condition, the threaded bolt 140 (or other such driving member) is rotated using an appropriate tool (e.g., an Allen wrench) to engage a head portion 144 of the bolt 140, thereby raising the nut 170 (or other such driven member) to raise the gripping members 130*a*, 130*b* for radial compression of the gripping surfaces 135*a*, 135*b* by the guiding surface 124 of the housing 120. The bolt 140 may be rotated until sufficient gripping engagement is achieved between the gripping members 130*a*, 130*b* and the external structure. As used herein, gripping engagement may include interlocking engagement with a recess, protrusion, or other such feature on the external structure, or friction or compression gripping engagement between the gripping members and the external structure. To retain the exemplary lockout device 100 in the locking condition, a padlock shackle (not shown) or other such locking component is inserted through aligned holes 125, 165 in the lock housing 120 and cap member 160, thereby blocking access to the threaded bolt 140 until the padlock is unlocked and withdrawn from the aligned holes 125, 165.

Figure 5A:
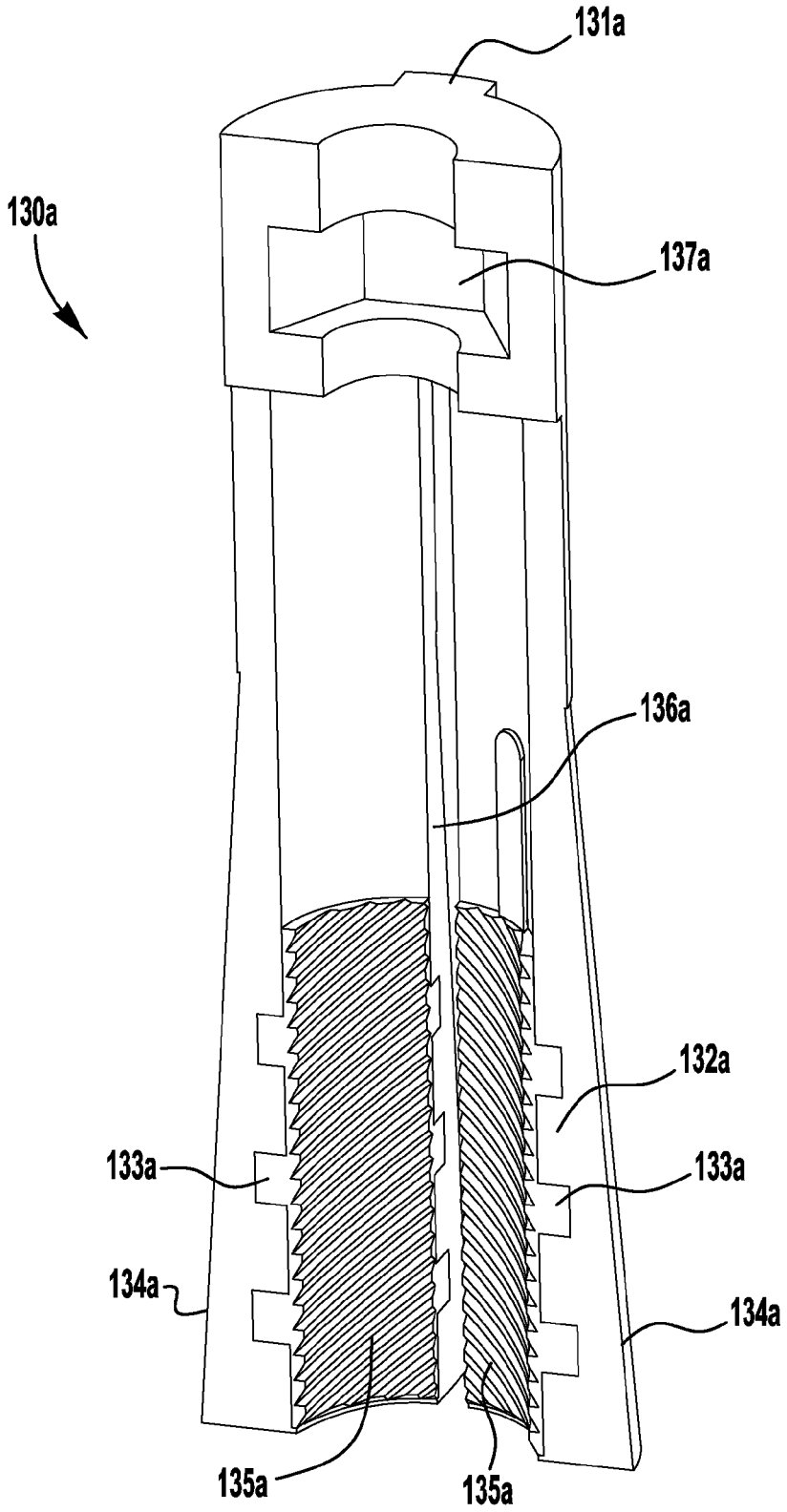
FIG. 5A is a front perspective view of an exemplary gripping member for a lockout device.
Figure 5B:
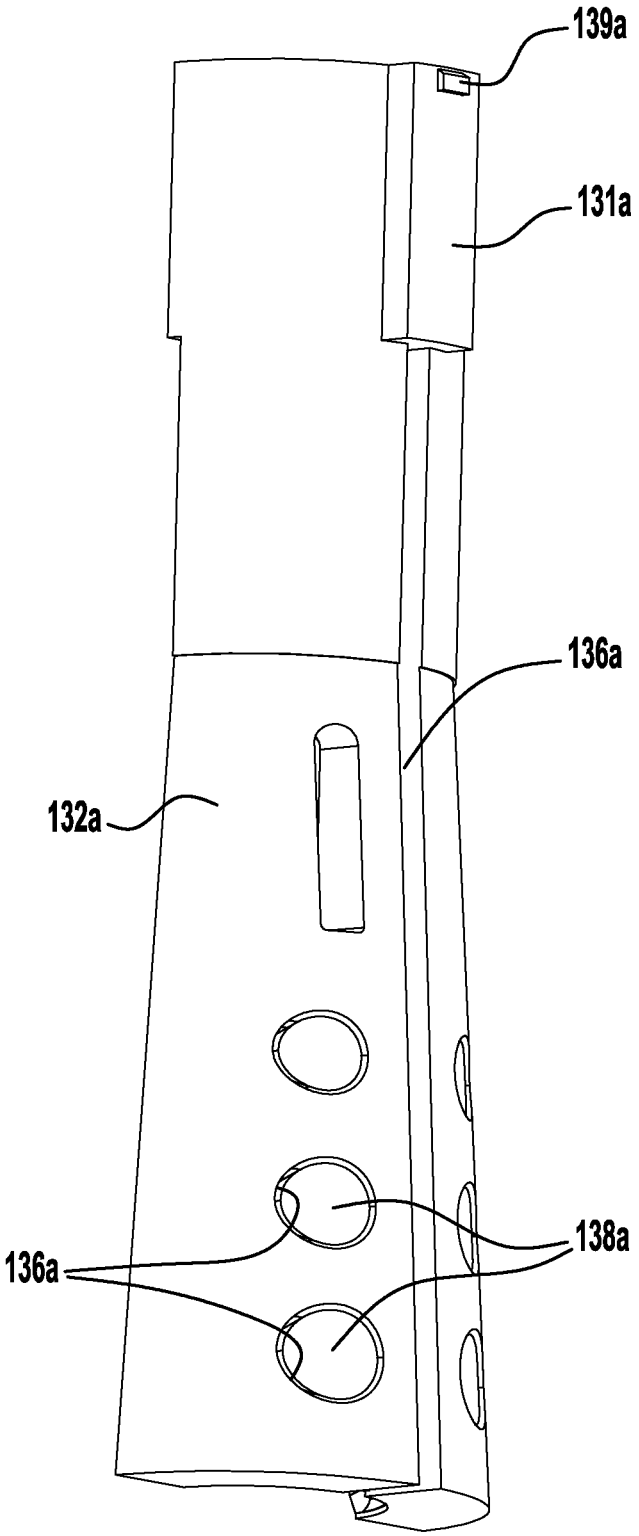
FIG. 5B is a rear perspective view of the gripping member of FIG. 5A.
Figure 6:
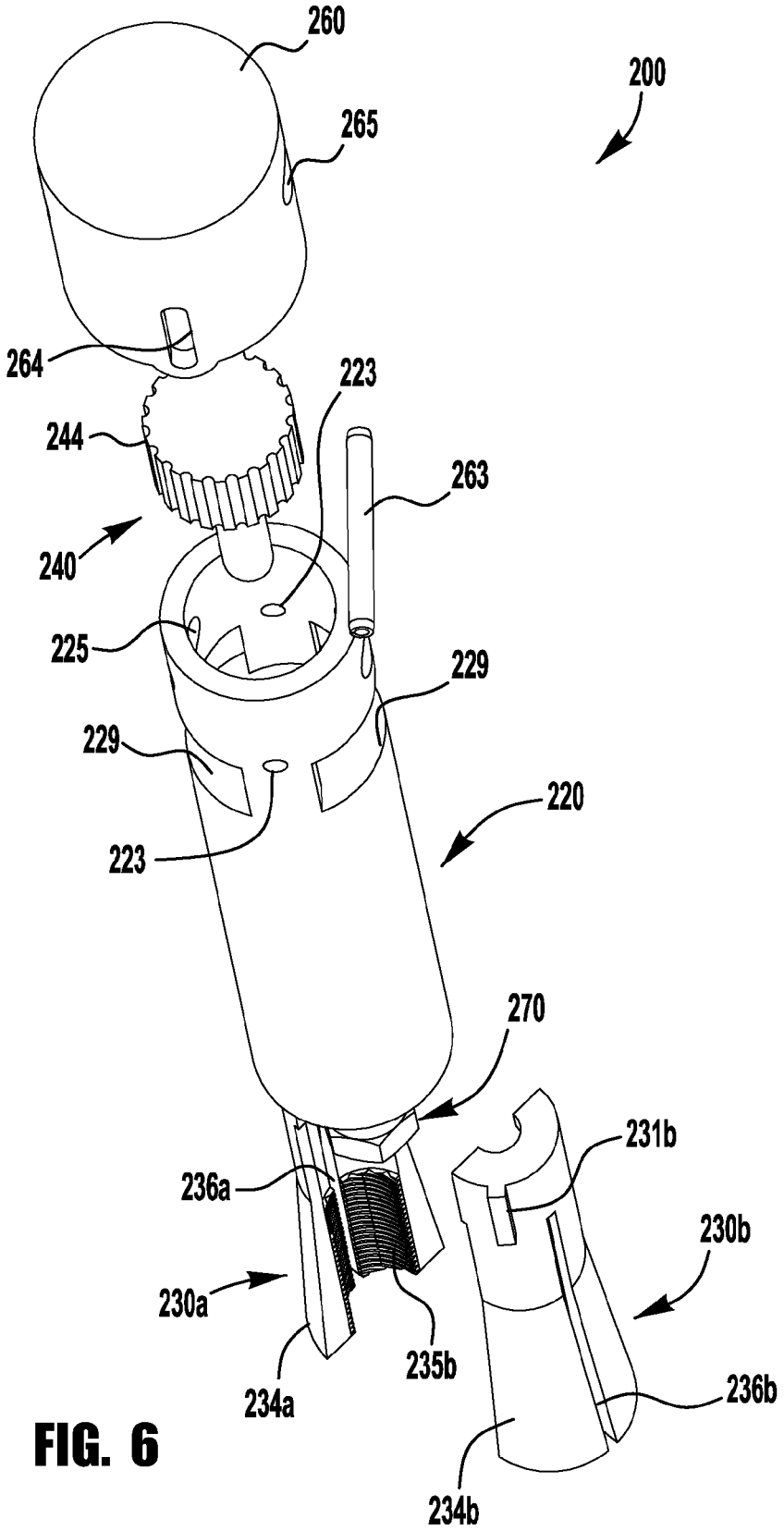
FIG. 6 is an exploded upper perspective view of another exemplary lockout device.
Figure 7:
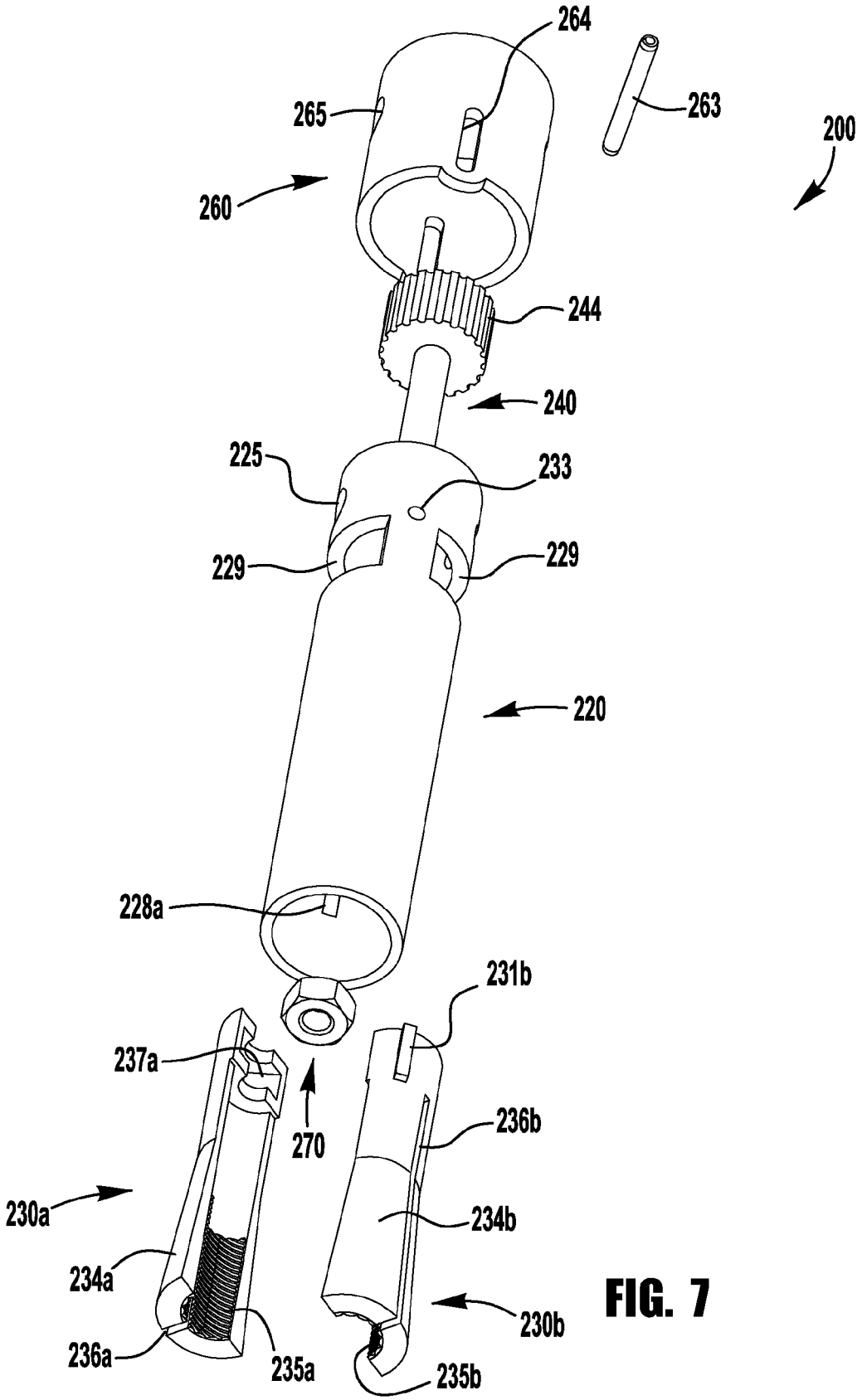
FIG. 7 is an exploded lower perspective view of the lockout device of FIG. 6.
Figure 8A:
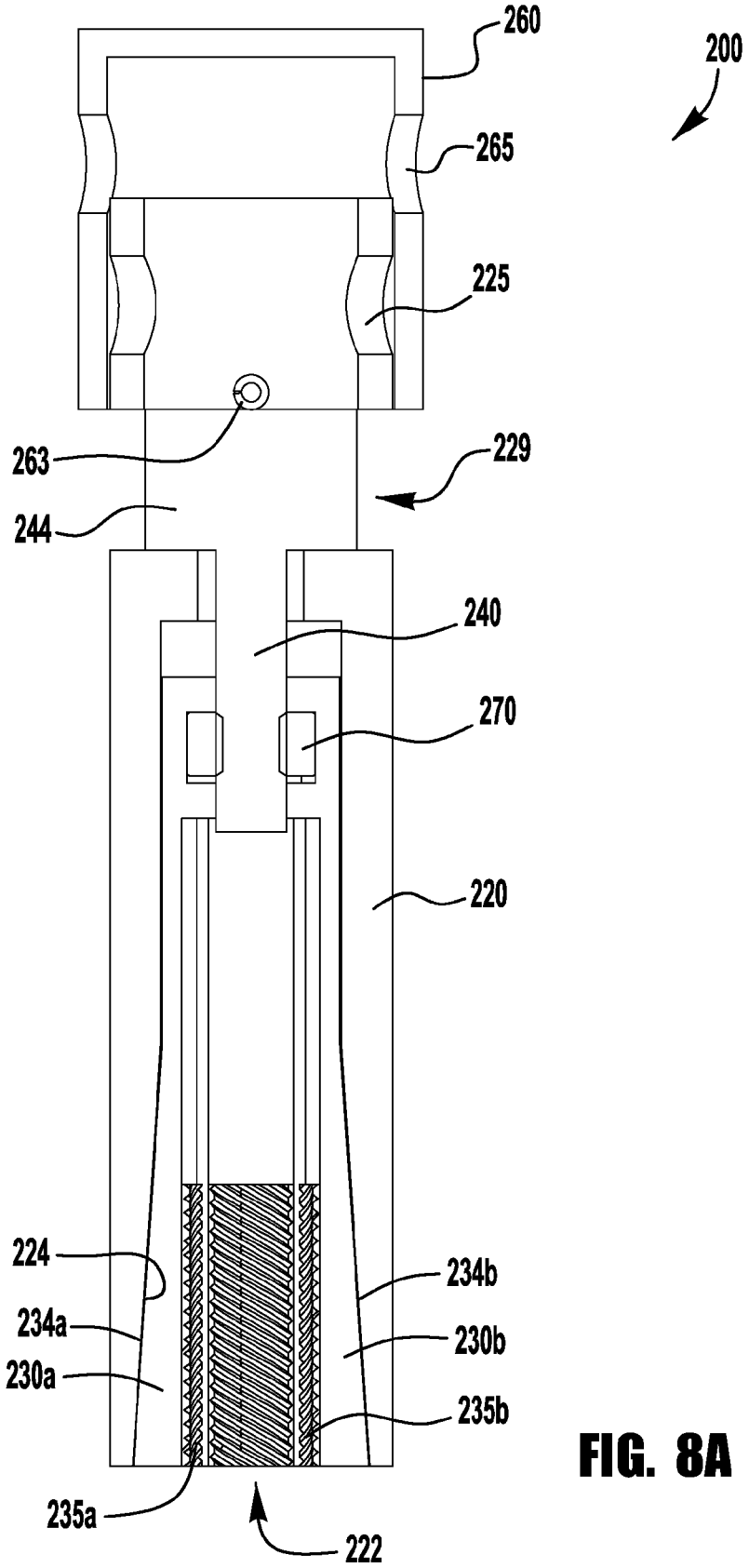
FIG. 8A is a side cross-sectional view of the lockout device of FIG. 6.
Figure 8B:
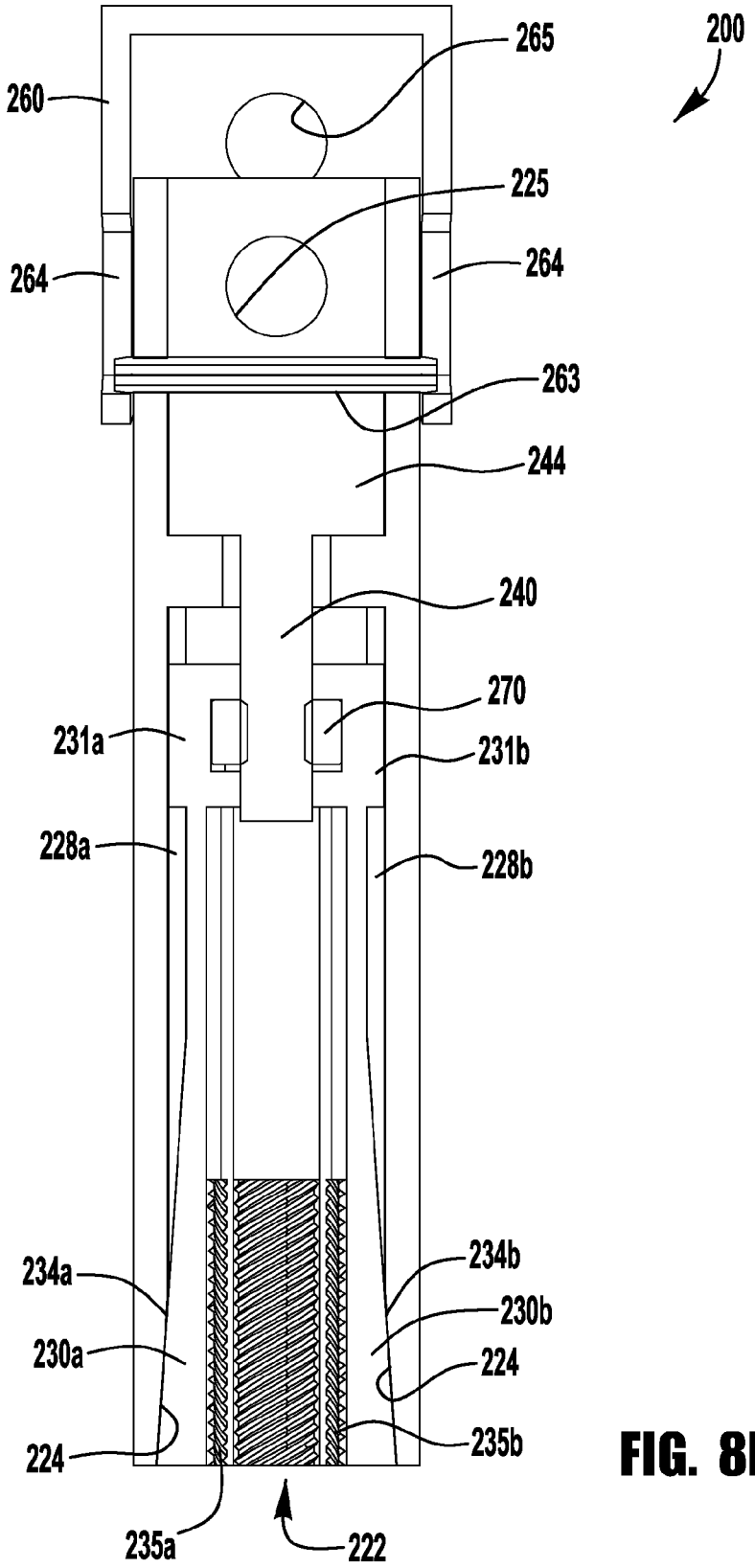
FIG. 8B is another side cross-sectional view of the lockout device of FIG. 6.
Figure 9:
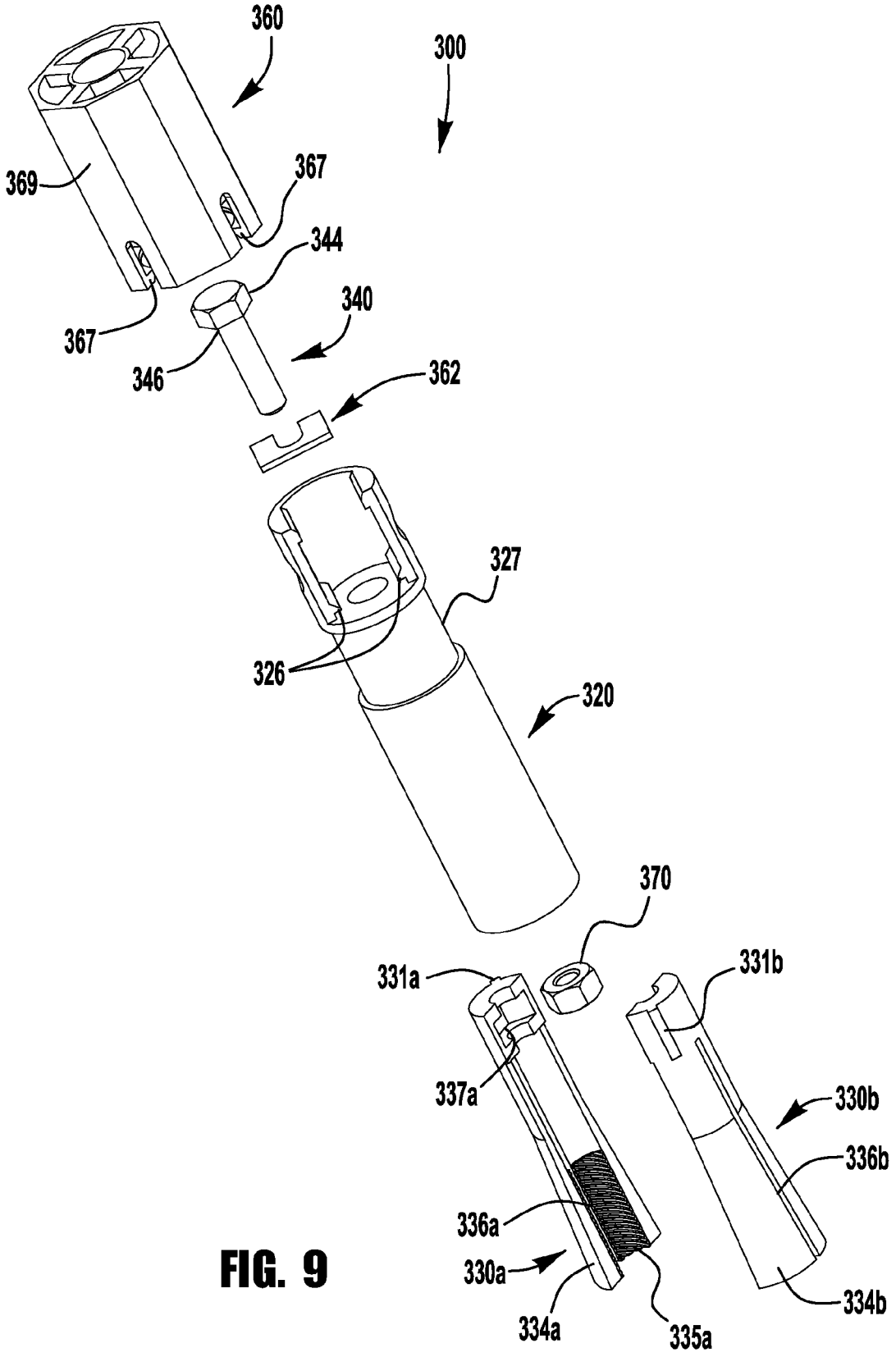
FIG. 9 is an exploded upper perspective view of still another exemplary lockout device.
Figure 10:
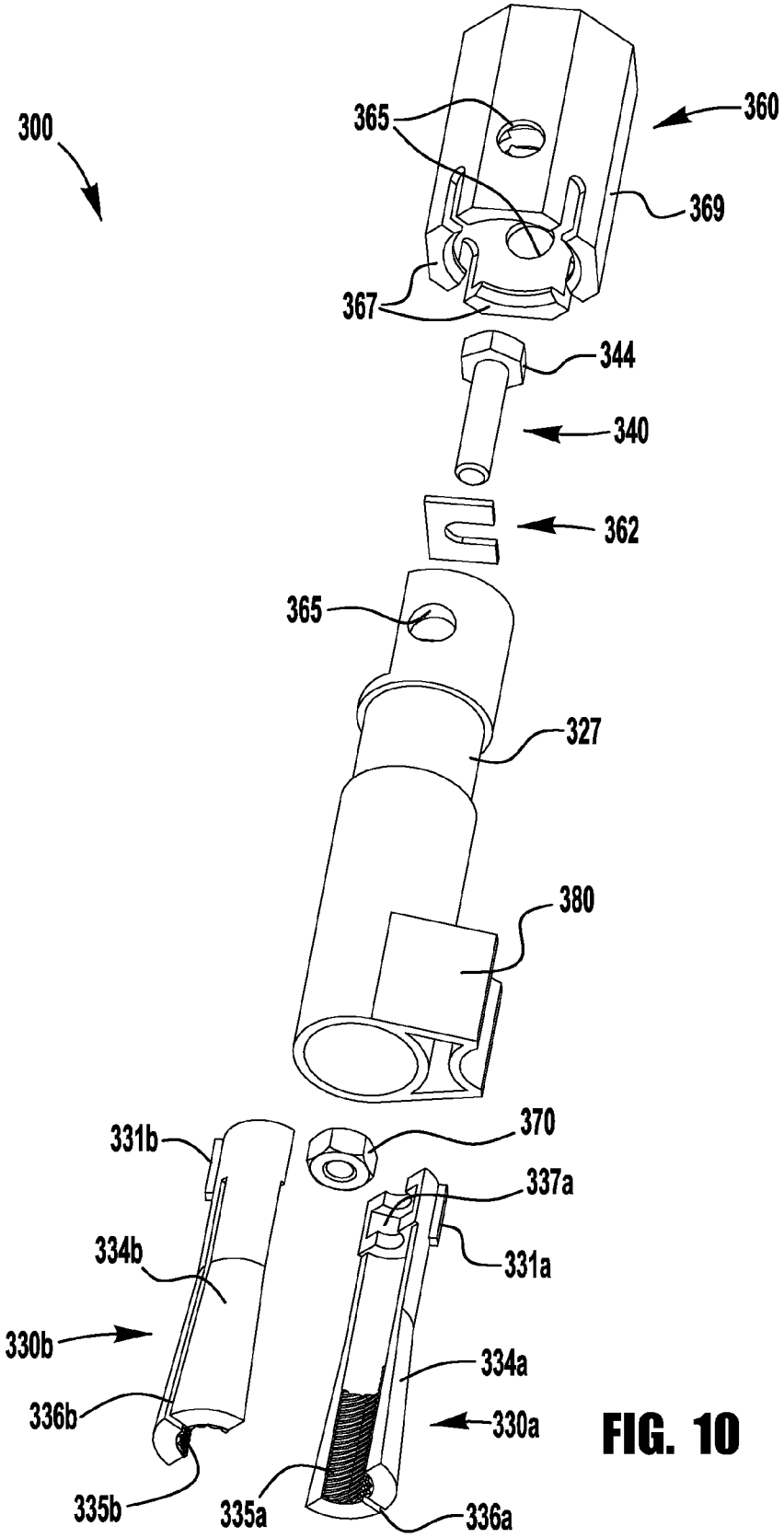
FIG. 10 is an exploded lower perspective view of the lockout device of FIG. 9.
Figure 11A:
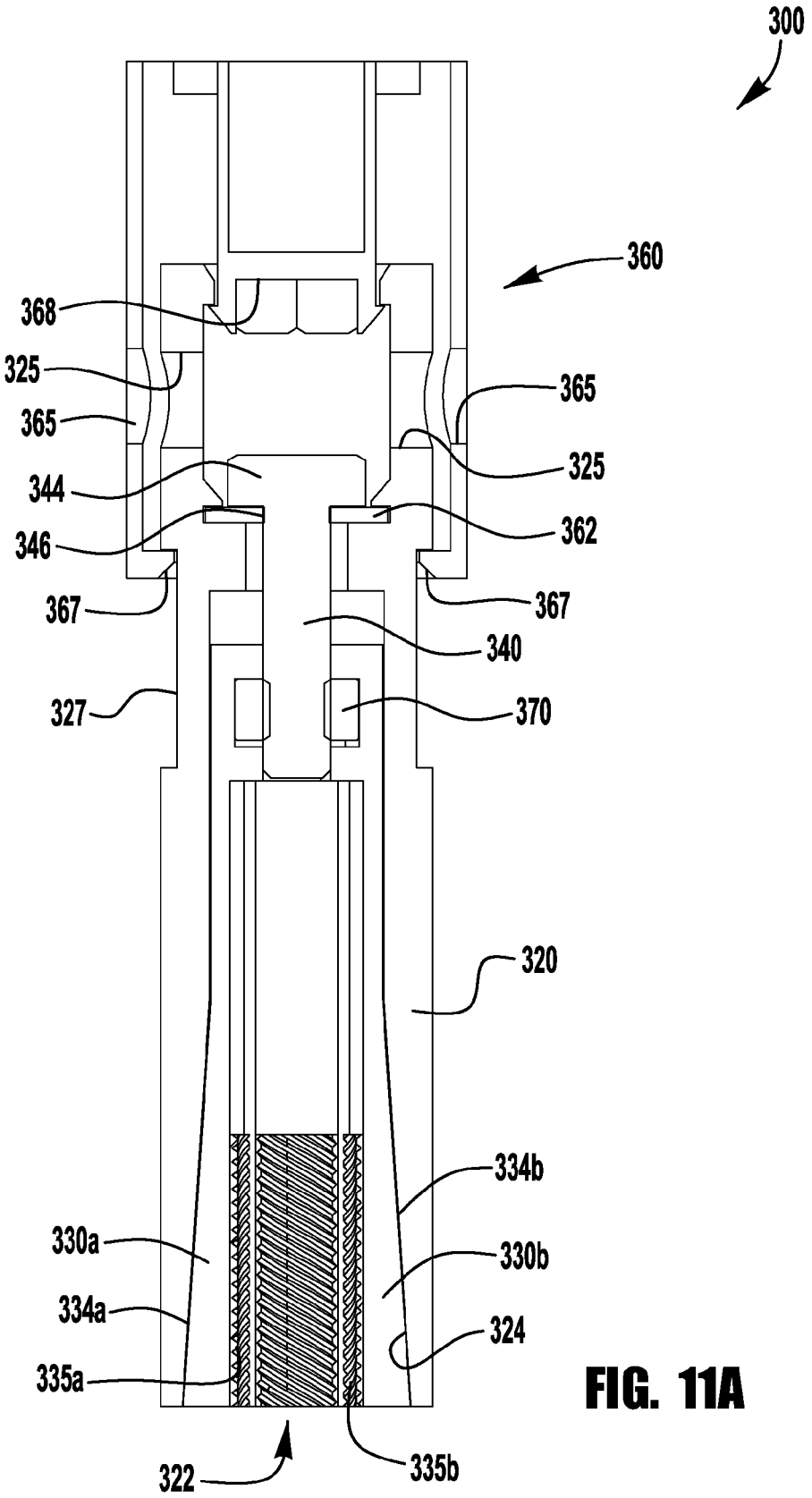
FIG. 11A is a side cross-sectional view of the lockout device of FIG. 9.
Figure 11B:
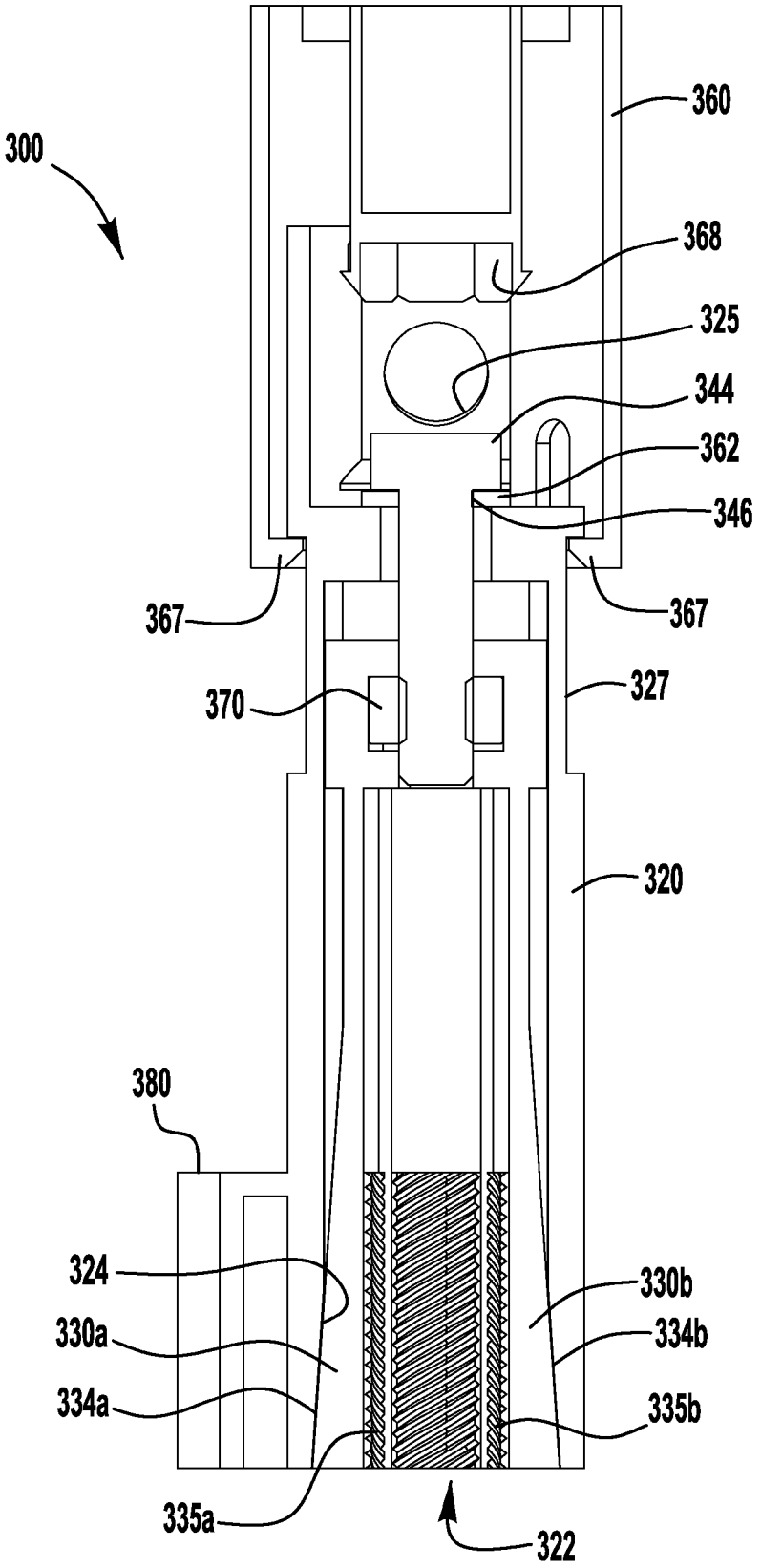
FIG. 11B is another side cross-sectional view of the lockout device of FIG. 9.

Many different arrangements may be utilized to facilitate smooth axial movement of the gripping members within the housing. In the illustrated embodiment, the gripping members 130*a*, 130*b* include outer ribs 131*a*, 131*b* or other such suitable projections that ride in corresponding notches 128*a*, 128*b* (see FIG. 4B) in the housing 120 when the gripping members are axially moved within the housing. As best shown in FIG. 5B, the outer periphery of the gripping members 130*a*, 130*b* may include an additional protrusion 139*a* for interlocking retention with the housing 120. The gripping members may also be configured such that pin engaging portions of the gripping members are flexed into gripping engagement with the pin (or other such structure) to be locked out. The gripping members 130*a*, 130*b* may include a flexible material, such as plastic, to facilitate this flexing movement upon engagement of the guiding surface 124 of the housing 120 with the mating surfaces 134*a*, 134*b* of the gripping members 130*a*, 130*b*. To further allow for radially inward flexing of the gripping members 130*a*, 130*b*, slots 136*a*, 136*b*, 136*c*, 136*d* may be provided in the gripping members and/or defined between adjacent edges of the gripping members. Additionally, internal gripping surfaces 135*a*, 135*b* of the gripping members may be provided with enhanced properties, such as greater hardness or friction, to increase the resulting grip on the pin (or other such structure) to be locked out. In an exemplary embodiment, as shown in FIGS. 5A and 5B, a gripping members 130*a* is produced as a multiple piece component (e.g., a two shot injection molded part or snap-fit assembly), with a flexible collet portion 132*a* including a relatively durable plastic material (e.g., Santoprene or Wondel® C, with 50% CG4 AND 50% CTA) and gripping or jaw portions 133*a* including a relatively hard plastic material (e.g., a polycarbonate), or a more compressible gripping material (e.g., TPE-TA60, 50-60 Shore D). As shown, the jaw portions 133*a* may include rear projections 138*a* that snap into corresponding openings 136*a* in the collet portion 132*a*.

In another exemplary embodiment, a lockout device is configured to receive a locking component such that a portion of the lockout device prevents access to a driving member of the lockout device to prevent manipulation of the driving member for movement to the unlocked condition. FIGS. 6-8B illustrate exploded perspective and cross-sectional views of an exemplary embodiment of a lockout device 200 for a pin-style electrical connector, with the lockout device 200 configured to receive a locking component (such as a padlock, not shown) to block user access to a driving member. The lockout device 200 includes a housing 220, first and second gripping members 230*a*, 230*b* (which may, but need not, be consistent with the gripping members 130*a*, 130*b* of the lockout device 100 of FIGS. 2-4B, as described above), a threaded driving member 240 (e.g., a bolt), and a threaded driven member 270 (e.g., a nut) captured between the gripping members 230*a*, 230*b* in cavities 237*a*, 237*b*. A cap member 260 may be rotationally secured to the housing 220 using any suitable arrangement, including, for example, a roll pin 263 (or other such fastener) secured through corresponding holes 223 in the housing 220 and axially extending slots 264 in the cap member 260, as shown. The exemplary driving member 240 is a threaded bolt axially fixed between a stepped portion 221 of the housing 220 and the roll pin 263. The illustrated cap member 260 is vertically slideable between a raised bolt accessing position and a lowered bolt covering position. Abutment of the roll pin 263 with the upper and lower ends of the slots 264 defines the raised and lowered positions of the cap member, respectively.

To secure the lockout device 200 to the external structure in a locking condition, the cap member 260 is placed in the raised position and the head 244 of the threaded bolt 240 (or other such driving member) is accessed through openings 229 in the housing 220 and rotated, thereby raising the nut 270 (or other such driven member) to raise the gripping members 230*a*, 230*b* for radial compression of the gripping surfaces 235*a*, 235*b*. by the guiding surfaces 224*a*, 224*b* of the housing 220. While a tool may be configured to rotate the bolt 240, in the illustrated embodiment, the bolt head 244 is sized and textured to facilitate hand rotation. The bolt 240 may be rotated until sufficient gripping engagement is achieved between the gripping members 230*a*, 230*b* and the external structure. To retain the lockout device 200 in the locking condition, the cap member 260 is placed in the lowered position to cover the bolt head, and a padlock shackle (not shown) or other such locking component is inserted through aligned holes 225, 265 in the lock housing 220 and cap member 260, thereby blocking access to the threaded bolt 240 until the padlock is unlocked and withdrawn from the aligned holes 225, 265 and the cap member 260 is moved back to the raised position.

In still another exemplary embodiment, a lockout device is configured to receive a locking component such that the locking component prevents operative engagement between a user graspable actuator and an internal driving member of the lockout device to prevent manipulation of the driving member for movement to the unlocked condition. In one such exemplary embodiment, a user rotatable actuator is axially moveably between a first position in which the actuator engages a driving member for movement between locked and unlocked conditions of the driving member, and a second position in which the actuator disengages the driving member, such that movement of the driving member is prevented. A locking component (e.g., padlock) may be used to secure the actuator in the second axial position to maintain a lockout condition of the device.

Figure 13:
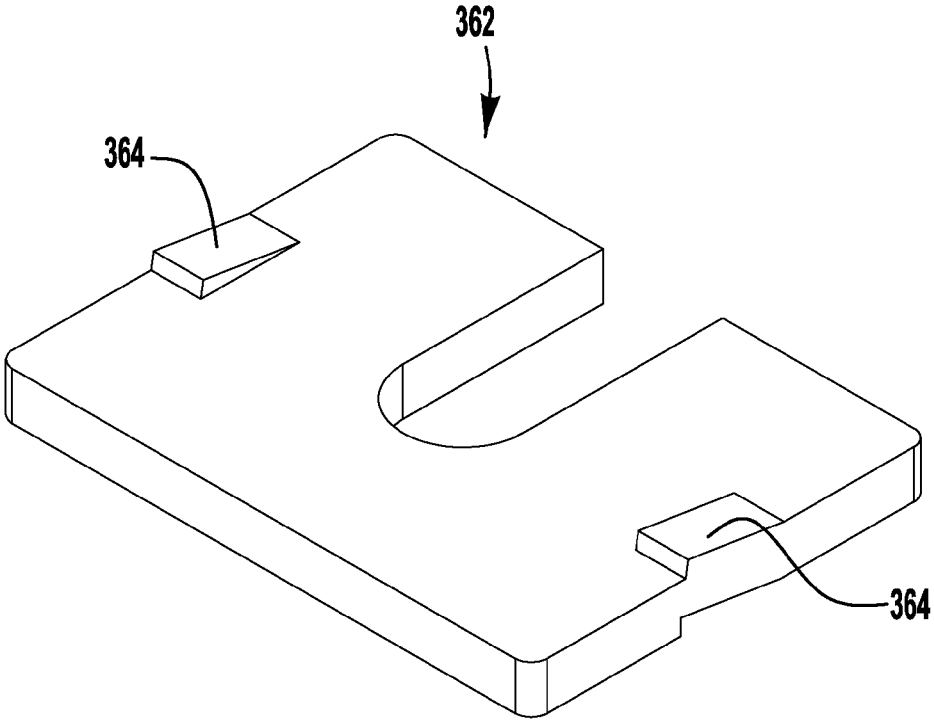
FIG. 13 is a perspective view of an exemplary collet plate for a lockout device.

FIGS. 9-11B illustrate exploded perspective and cross-sectional views of an exemplary embodiment of a lockout device 300 for a pin-style electrical connector, with the lockout device 300 configured to receive a locking component (such as a padlock, not shown) to block user access to a driving member. The lockout device 300 includes a housing 320, first and second gripping members 330*a*, 330*b* (which may, but need not, be consistent with the gripping members 130*a*, 130*b* of the lockout device 100 of FIGS. 2-4B, as described above), a threaded driving member 340 (e.g., a bolt), and a threaded driven member 370 (e.g., a nut) captured between the gripping members 330*a*, 330*b* in cavities 337*a*, 337*b*. The exemplary driving member 340 is a threaded bolt axially fixed by a collet plate 362 received in aligned grooves 326, 346 in the housing 320 and driving member 340. A side portion of the upper end of the housing 320 is open to allow for installation of the collet plate 362. As shown in FIG. 13, the collet plate 362 may be provided with raised portions 364, for example, to facilitate retention of the bolt 340 within the housing 320. The cap member 360 may be secured to the housing 320 using any suitable arrangement, including, for example, flanged tabs 367 extending from the cap member 360 to interlock with a corresponding undercut 327 in the housing 320. The illustrated cap member 360 is axially slideable between a raised bolt disengaged position and a lowered bolt engaging position, in which the bolt head 344 is received in a complementary shaped recess 368 in the cap member 360 for co-rotation of the cap member and bolt, such that the cap member 360 functions as a user graspable actuator. Abutment of the flanged tabs 367 with the upper and lower edges of the undercut 327 defines the raised and lowered positions of the cap member, respectively.

To secure the lockout device 300 to the external structure in a locking condition, the cap member 360 is placed in the lowered position to receive the bolt head 344 within the recess 368, and the cap member 360 is rotated to rotate the bolt 340 and raise the nut 370 (or other such driven member) to raise the gripping members 330*a*, 330*b* for radial compression of the gripping surfaces 335*a*, 335*b* by the guiding surfaces

Figure 12:
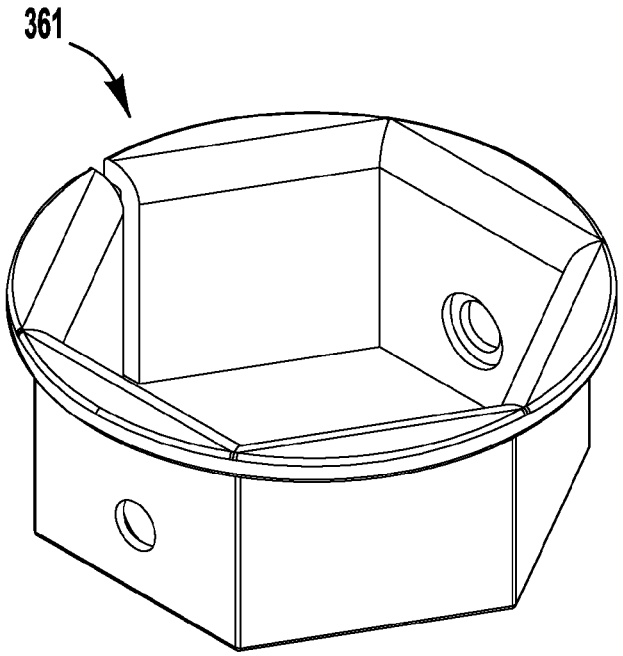
FIG. 12 is a perspective view of an exemplary reinforcing actuator insert for a lockout device.

324*a*, 324*b* of the housing 320. As shown, the cap member 360 may be provided with external hex flats 369 (or other suitable tool engagement features, such as a screwdriver head slot) for use of a wrench or other tool to assist in rotation of the cap member 360 and bolt 340. The hex flats may be reinforced with a rigid insert (e.g., metal), for example, to increase strength and wear resistance. An exemplary reinforcing insert 361 is illustrated in FIG. 12. The bolt 340 may be rotated until sufficient gripping engagement is achieved between the gripping members 330*a*, 330*b* and the external structure. To retain the lockout device 300 in the locking condition, an actuator or cap member 360 is placed in the raised position to disengage the cap member from the bolt 340, and a padlock shackle (not shown) or other such locking component is inserted through aligned holes 325, 365 in the lock housing 320 and cap member 360, thereby preventing re-engagement of the cap member 360 with the bolt 340.

Figure 14:
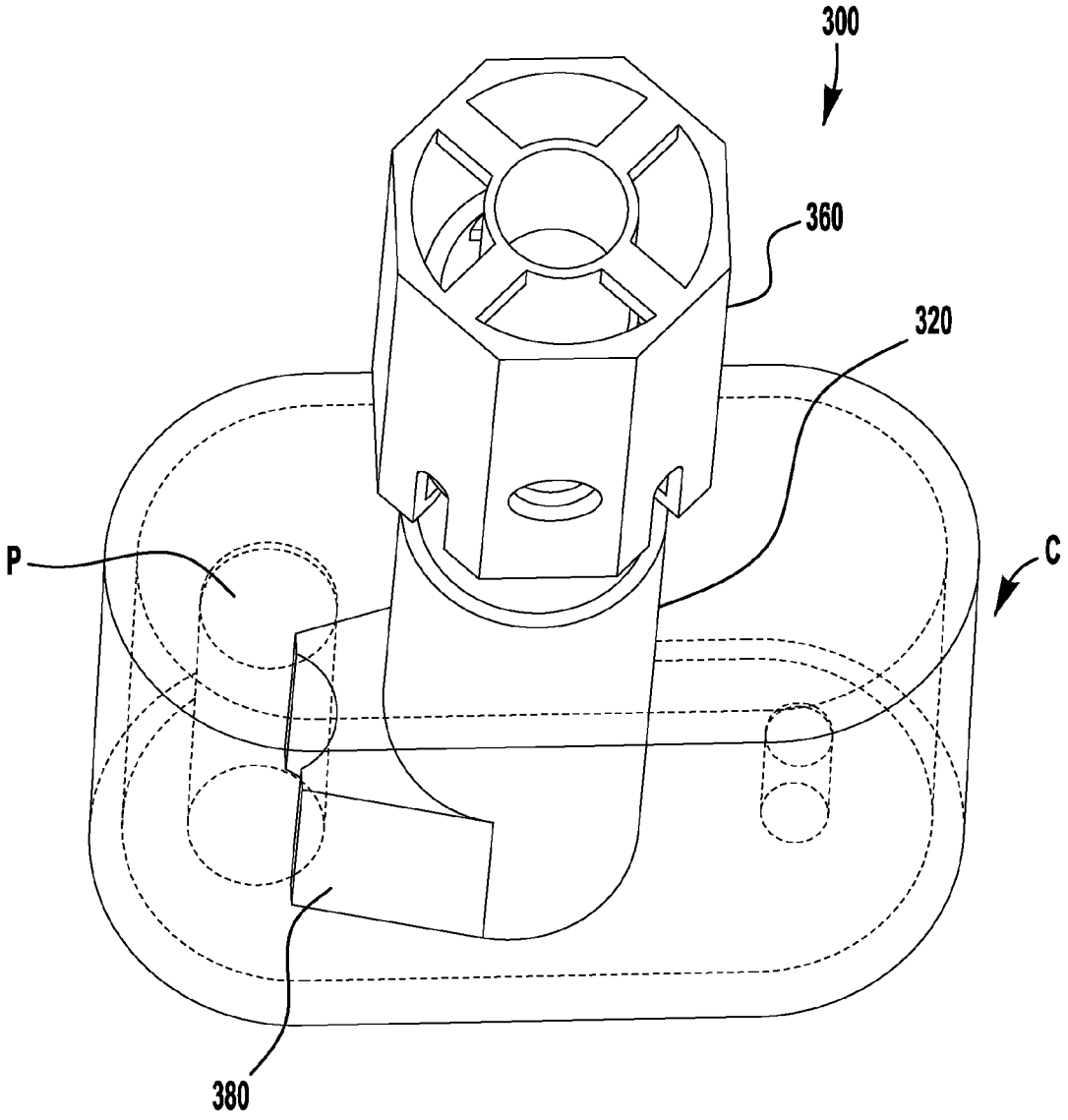
FIG. 14 is a perspective view of an exemplary lockout device assembled with a pin of a three-pin power connector, with the power connector shown in phantom to illustrate additional features of the lockout device.

Other features may be provided with the lockout devices described herein. For example, as shown in FIG. 14, the housing 320 of a lockout device 300 may include a radially extending projection 380 sized and contoured to interlock with an adjacent pin P of a multiple pin electrical connection C, for example, to prevent rotation of the housing 320 during installation of the lockout device 300. In an exemplary embodiment, the lockout device is configured to be secured to a first pin of a multi-pin aircraft power connector (e.g., a 3-pin power connector, as shown in FIG. 14) located in the fuselage of the aircraft, with the lockout device sized to be secured to a first pin, and the housing projection sized to interlock with an adjacent second pin of the power connector. As another feature, an aircraft power connector pin lockout device may be sized such that closure of the fuselage door is prevented, thereby providing clearer visual notice to the user that the power connector is in a locked out condition. As still another feature, at least a portion of the outer surface of the housing may be sized and/or contoured to accommodate attachment of a safety warning label or other informational label.

While the components of the exemplary lockout devices described herein may be provided in any suitable material, in one embodiment, the lockout device includes non-conductive materials, such as plastic, to sufficiently insulate an electrically conductive power connection to be locked out. In one such exemplary embodiment, the housing, cap, and gripping members are provided in or include thermoplastic, and the bolt and nut are provided in or include corrosion resistant steel. As one example, the housing may include a modified polycarbonate material, such as, for example, Wondel® C, with 50% CG4 AND 50% CTA. The gripping members may be provided in a softer, more compressible material, such as a thermoplastic elastomer (TPE) (e.g., TA60).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A method of locking out a power connection including at least a first pin, the method comprising:

inserting the first pin into an opening in a housing of a lockout device and between gripping surfaces of at least one gripping member disposed within the housing; and actuating a driving member, operatively connected with the at least one gripping member and assembled with the housing, from a release position to a lockout position, to axially move the at least one gripping member within the housing, such that internal surfaces of the housing urge the at least one gripping member into gripping engagement with the first pin, wherein actuating the driving member from the release position to the lockout position comprises rotating an actuator engaged with the driving member; and axially moving the actuator out of engagement with the driving member to prevent movement of the driving member out of the lockout position.

2. The method of claim 1, further comprising inserting a lock member through a lock aperture in the housing to prevent movement of the driving member from the lockout position to the release position.

3. The method of claim 2, wherein inserting the lock member through the lock aperture blocks access to the driving member through an access opening in the housing.

4. The method of claim 2, wherein inserting the lock member through the lock aperture secures a cap assembled with the housing in a position blocking access to the driving member.

5. The method of claim 4, wherein inserting the lock member through the lock aperture comprises inserting the lock member through aligned lock apertures in the housing and the cap.

6. The method of claim 1, further comprising inserting a lock member through aligned lock apertures in the housing and the actuator to prevent re-engagement of the actuator with the driving member.

7. The method of claim 1, further comprising interlocking a radially extending projection of the body with a second pin of the power connection to limit rotation of the housing.

8. A lockout device configured to be lockingly secured to a cylindrical pin of a male electrical connector of an aircraft, to block access to the electrical connector, the lockout device comprising:

a housing defining an opening sized to receive the cylindrical pin; and at least one gripping member disposed within the housing and positioned to receive the cylindrical pin, the at least one gripping member being movable in an axial direction between a first position in which internal surfaces of the housing urge internal gripping surfaces of the at least one gripping member into frictional gripping engagement with an outer cylindrical surface of the cylindrical pin, and a second position in which the internal surfaces of the housing allow the at least one gripping member to release the outer cylindrical surface of the cylindrical pin from the frictional gripping engagement wherein the internal gripping surfaces of the at least one gripping member to release the outer cylindrical surface of the cylindrical pin from the frictional gripping engagement wherein the internal gripping surfaces of the at least one gripping member are curved for gripping engagement around a circumference of the cylindrical pin; and wherein the housing comprises a lock aperture sized to receive a locking member therethrough to prevent user movement of at least one gripping member from the first position.

9. A lockout device configured to be lockingly secured to an external structure extending in an axial direction, to block access to the external structure, the lockout device comprising:

a housing defining an opening sized to receive the external structure;

at least one gripping member disposed within the housing and positioned to receive the external structure, the at least one gripping member being movable in the axial direction between a first position in which internal surfaces of the housing urge the at least one gripping member into gripping engagement with the external structure, and a second position in which the internal surfaces of the housing allow the at least one gripping member to expand to release the external structure;

a driving member assembled with the housing and operatively connected with the at least one gripping member for movement of the at least one gripping member between the first and second positions; and an actuator assembled with the housing and movable in the axial direction between a first position in which actuator engages the driving member for user operation of the driving member, and a second position in which the actuator disengages the driving member to prevent user operation of the driving member.

10. The lockout device of claim 9, wherein the driving member is operatively connected with the at least one gripping member by a driven member axially secured with the at least one gripping member.

11. The lockout device of claim 10, wherein the driving member comprises a threaded bolt axially secured with the housing, and the driven member comprises a threaded nut in threaded engagement with the threaded bolt, such that rotation of the threaded bolt moves the threaded nut in an axial direction with respect to the housing.

12. The lockout device of claim 9, wherein the driving member is accessible through an access opening in the housing for operation of the driving member.

13. The lockout device of claim 12, wherein insertion of a lock member through a lock aperture disposed in the housing blocks access to the driving member through the access opening.

14. The lockout device of claim 12, further comprising a cap assembled with the housing and movable between a first position in which the cap blocks access to the access opening, and a second position in which the cap is positioned to permit access to the access opening for operation of the driving member.

15. The lockout device of claim 14, wherein insertion of a lock member through a lock aperture disposed in the housing secures the cap in the first position.

16. The lockout device of claim 14, wherein the cap is movable in an axial direction between the first and second positions.

17. The lockout device of claim 9, wherein insertion of a lock member through a lock aperture disposed in the housing secures the actuator in the second position.

18. The lockout device of claim 9, wherein the housing comprises a radially extending projection, wherein the lockout device is sized to be secured to a first pin of a multiple pin power connector, and the radially extending projection is sized to interlock with a second pin of the multiple pin power connector to prevent rotation of the housing during installation of the lockout device.

19. The lockout device of claim 9, wherein the housing comprises a lock aperture sized to receive a locking member therethrough to prevent operation of the driving member to secure the at least one gripping member in the first position.

* * * * *